United States Patent [19]

Jewett, Sr.

[11] Patent Number: 4,769,953

[45] Date of Patent: Sep. 13, 1988

[54] LENS GENERATING SYSTEM

[75] Inventor: Bryce D. Jewett, Sr., Richmond, Va.

[73] Assignee: RXTEC Incorporated, Richmond, Va.

[21] Appl. No.: 934,169

[22] Filed: Nov. 20, 1986

[51] Int. Cl.[4] ..... B24B 13/00

[52] U.S. Cl. ..... 51/124 L; 51/105 LG; 51/284 R

[58] Field of Search ..... 51/124, 284 R, 105 LG, 51/125.5

[56] References Cited

U.S. PATENT DOCUMENTS

| | | | |
|---|---|---|---|
| 1,800,308 | 4/1931 | Maynard | 51/124 L |
| 2,589,488 | 3/1952 | Fowler | 51/124 L |
| 2,747,339 | 5/1956 | Schelling | 51/124 L |
| 4,653,233 | 3/1987 | Brueck | 51/124 L |

*Primary Examiner*—Frederick R. Schmidt
*Assistant Examiner*—Robert A. Rose
*Attorney, Agent, or Firm*—Norman B. Rainer

[57] ABSTRACT

An opthalmic toric lens surface is generated by rotating a generating wheel and swinging past it a lens blank on a radius arm which can be varied in radius to vary lens surface curvature.

1 Claim, 3 Drawing Sheets

LENS GENERATING SYSTEM

BACKGROUND OF THE INVENTION

Opthalmic lenses are generally made from blanks furnished with their convex front surfaces already finished, and their back surfaces only partially concave. The concave toric surfaces required under prescriptions for astigmatism are thereafter generated on the back of each blank in compliance with the prescription.

Conventional equipment presently available for such toric concave surface generation is designed with a fixed position for the center of sweeping movement of a rotating cup-shaped cutter past the blank, or vise versa. To change the radius to adjust the surface curvature the motor is moved toward or away from the said fixed center. The net effect of this design condition is to complicate changing the radius to such an extent that it is generally considered necessary for a producer of prescription opthalmic lenses to buy at least two units of concave surface generating equipment to cover the whole range of diopters (about 1½ to 20) required to serve the market.

SUMMARY OF THE INVENTION

In accordance with the present invention, the lens generating sweep is made with a variable radius arrangement which moves the center of the sweep relative to the motor. As a consequence, one unit of generating equipment of the invention is able to generate the whole range of diopter curvatures required for making toric concave back surfaces usually required for individual prescription lenses.

Other objects, advantages and details will become apparent as the following description proceeds.

BRIEF DESCRIPTION OF THE DRAWINGS

The accompanying drawings show semi-diagrammatically, for purposes of illustration only, a present preferred embodiment of the invention, in which.

DETAILED DESCRIPTION OF THE PRESENT PREFERRED EMBODIMENT

Figure 1:
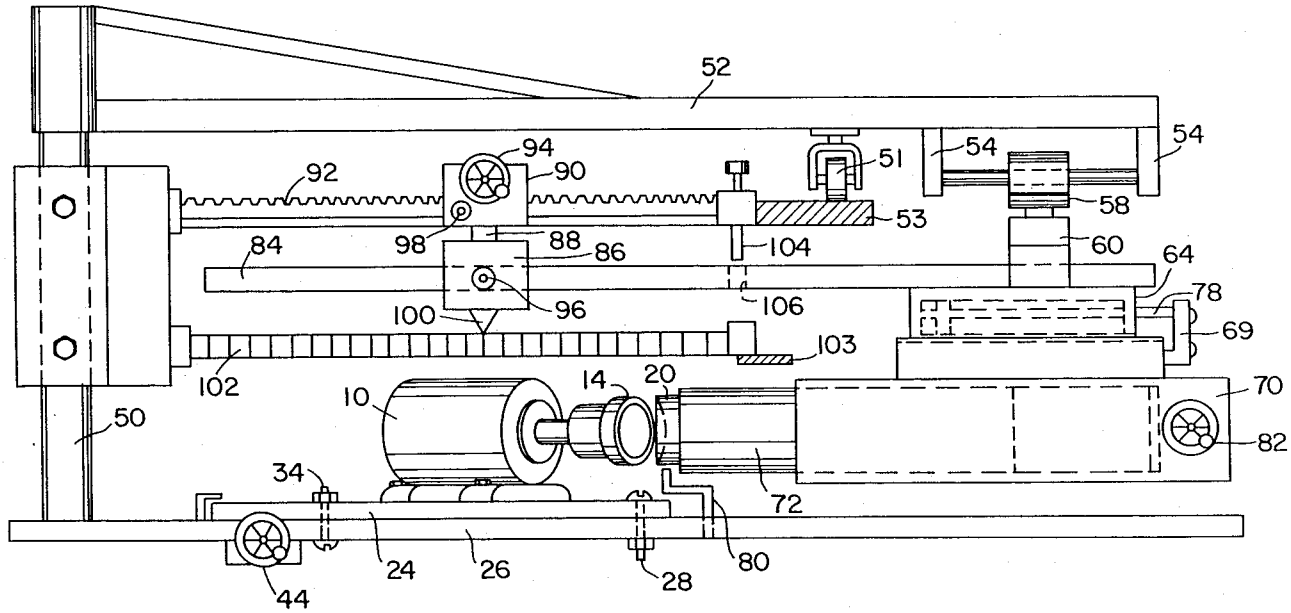
FIG. 1 shows a side view of the present preferred embodiment.

Referring now more particularly to the drawings, a motor 10 rotates a chuck 12 holding a cup-shaped tool 14, such as a diamond wheel, suitable for generating a toric concave lens surface 16 on a face 18 of a lens blank 20 which is to become the back face of the final lens.

A motor support plate 24 rests on a main base plate 26 and slides thereon about a pivot pin 28. The pin 28 is secured in a fixed position on base plate 26 and is in the form of a bolt extending upwardly through close fitting openings in plates 24 and 26. A bolt 30 extends upwardly, through a close fitting opening through plates 26 and through an arcuate slot 32 in motor plate 24. A threaded knob or nut 34 rotates on bolt 30 in one direction to lock motor plate 24 to base plate 26 and in the opposite direction to release plate 24 for pivotal movement about pin 28. An arcuate slot 36 through base plate

26 receives a stud 38 projecting upwardly from a worm block 39 having a threaded opening receiving a worm 40 beneath base plate 26. A threaded knob or nut 42 on stud 38 can be turned to lock motor plate to the worm block 39 and base plate 26. A manually operable hand wheel 44 rotates worm 40 to shift the worm block and with it motor plate 24 for purposes of adjusting the pivotal position of motor plate 24 about its pivot pin 28. Nut 34 is released only to permit such adjusting movement. When tool 14 is replaced by another of different diameter, motor 10 is moved sideways to keep the pivotal axis of pin 28 tangent to the leading part of the cutting edge of the tool in generating contact with blank 20. To permit such sidewise movement the bottom of motor 10 has flanges 46 with slots 48 parallel to the sidewise movement and receiving releasable bolts 49 connecting motor 10 to motor plate 24. The bolts 49 are released only for purposes of such sidewise adjustment.

A support arm 52 swings horizontally about a pivotal mounting at the top of a post 50 on base plate 20. Further support for arm 52 is provided by a roller 51 mounted beneath arm 52 near its outer end and adapted to roll against the horizontal top surface of a support plate 53 connected between a pair of posts **55*a* and 55*b* on base plate 26**.

The outer end of arm 52 supports a pair of bracket arms 54 connected to opposite ends of a horizontal slide bar 56 extending generally parallel to the length of arm 52. A block 58 slides along bar 56 and carries a lower block 60 through a pivot pin 62 which holds the two blocks together while permitting relative rotation between them about the vertical axis of pin 62. An integral lower component of block 60 is fixed to the top of a piston cylinder 64. A horizontally extending dovetail slide 66 connects the bottom of piston chamber 64 to the top of a structural element 68 projecting integrally above a rigid cylindrical sleeve 70, so that piston cylinder 64 and structural element 68 are held together except for relative sliding movement in a horizontal direction parallal to the central axis through the center of blank 20. A cylindrical blank holding member 72 holds the blank 20 at its forward end and at its rear end most of its length slides horizontally within sleeve 70, in a direction parallel to the central axis through the center of blank 20.

A double acting piston 76 within piston cylinder 64 has its piston rod 78 connected by connection 69 to structural element 68 to move the whole assembly of the structural element 68, sleeve 70, blank holder 72, and blank 20 in a forward direction toward tool 14 until blank holder 20 engages a fixed stop 80 secured to base plate 26. The apparatus is designed to have tool 14 in position to cut all the way through the center of the blank 10 when the blank holder 74 reaches stop 80. A hand wheel 82, which is conventionally mounted on the rear end of sleeve 70 for manual operation to adjust the position of blank holder 74 in sleeve 70, is then operated to retract the blank holder enough in sleeve 70 to provide the desired final thickness of the lens to be generated on blank 20 by tool 14.

Blank 20 is swept in a horizontal arc past tool 14 as it rotates about a fixed horizontal axis, for purposes of generating a toric lens surface on blank 20. Also, for that purpose the axis of rotation of the tool must be at an angle to the central axis through the center of the blank 20. If the surface generated is to be concave, as illustrated, the center of the arc must be where the tool is between the arc center and the blank, and if convex, the center of the arc must be where the blank is between the arc center and the tool.

The radius of sweep of blank 20 past tool 14 controls the radius of curvature of the generated surface in the horizontal plane through the center of blank 20. Such sweep is caused and controlled in illustrated apparatus by a radius arm 84 which swings horizontally, carrying blank 20 with it. Its outer end of radius 84 is secured between block 60 and piston chamber 64. Its other end is slidable through a block 86. A pivot pin 88 connects block 86 to a block 90, so that the blocks are held together by the pin but are freely rotatable relative to each other about the pin's vertical central axis. Block 90 is supported on a horizontal rack 92 extending parallel to arm 52 and held between bracket arms secured to arm 52 mounted in a fixed position on a support arm 52. A hand wheel 94 is manually operable to rotate a pinion for moving block 90 horizontally along rack 92. A pair of control handles 96 and 98 on the respective blocks 86 and 90 turn in one direction to lock the respective blocks 86 and 90 to arm 84 and rack 92, and in the other direction to release the blocks, through conventional spring and air pressure means (not shown). The blocks 86 and 90 are released only while wheel 94 is in use.

Block 86 carries a pointer 100 next to a fixed linear scale 102 fastened at one end to post 50 and at the other end to a fixed horizontal support 103 secured between posts 55*a* and *b*. The scale is marked to indicate the effective radius sweep of blank 20 in successibe positions of block 86 along radius arm 84.

One end of the fixed rack 92 mounts a vertically moveable connecting member 104 which can be moved down to enter an opening 106 in radius arm 84 when the apparatus is not generating a lens surface, and up to leave the opening 104 before starting to generate a lens surface. Use of connecting member 104 is not essential but it aids in aligning radius arm 84 with rack 92 between lens generating operations, preliminary to adjusting the radius of sweep of blank 20 past tool 14. This adjustment is made by releasing both of the set screws operated by knobs 96 and 98, and then operating hand wheel 94.

When connecting member 104 is inserted in opening 106 radius arm 84 extends parallel to rack 92 and thereby causes the vertical central axes of post 50, pivot pin 88, connecting member 104, pivot pin 62 and motor pivot pin 28 to lie in the same vertical plane. When this occurs the same vertical plane extends through the center line of support arm 52 and radius arm 84 and through the horizontal central axis of sleeve 70 and holder 74, and through the horizontal central axis through the center of blank 20 (in all positions of blank 20 controlled by hand wheel 82 and by operation of double acting piston 76). When blank 20 is in position for surfacing by tool 14, the arc of tool 14 which will be in contact with the surface to be generated on blank 20 is tangent to the said vertical plane.

Figure 2:
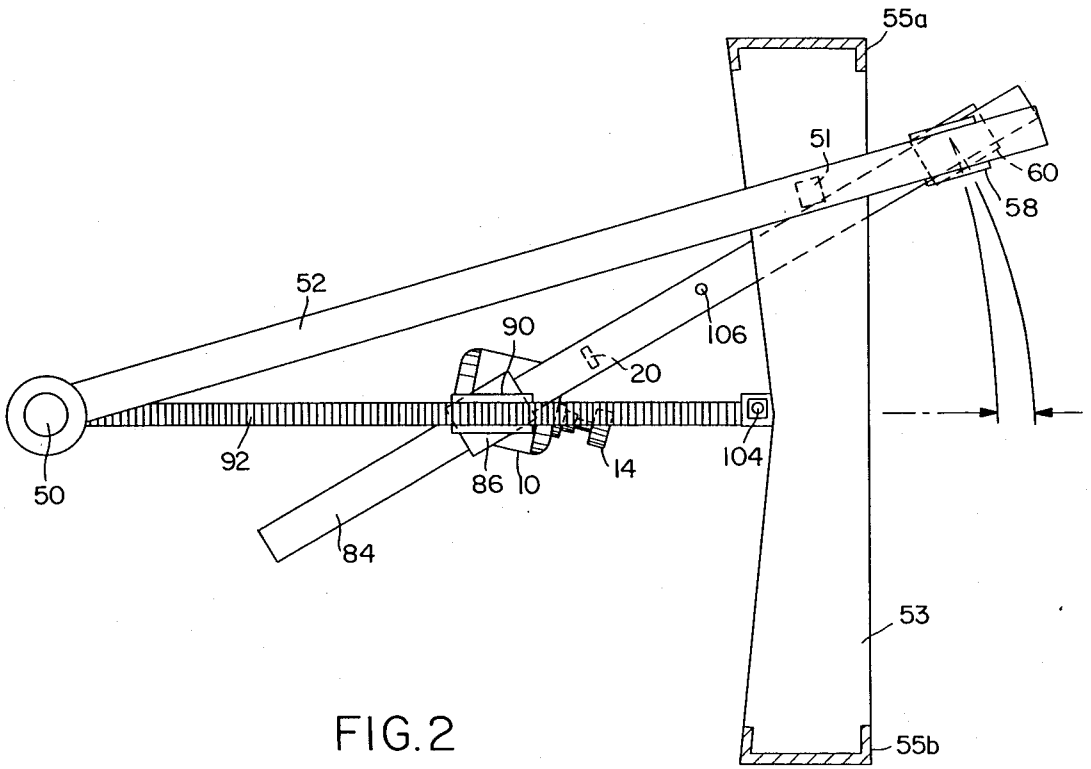
FIG. 2 shows a plan view of certain major elements shown in FIG. 1 in their position at the beginning of a sweep of the lens blank past the rotating lens generating tool.
Figure 3:
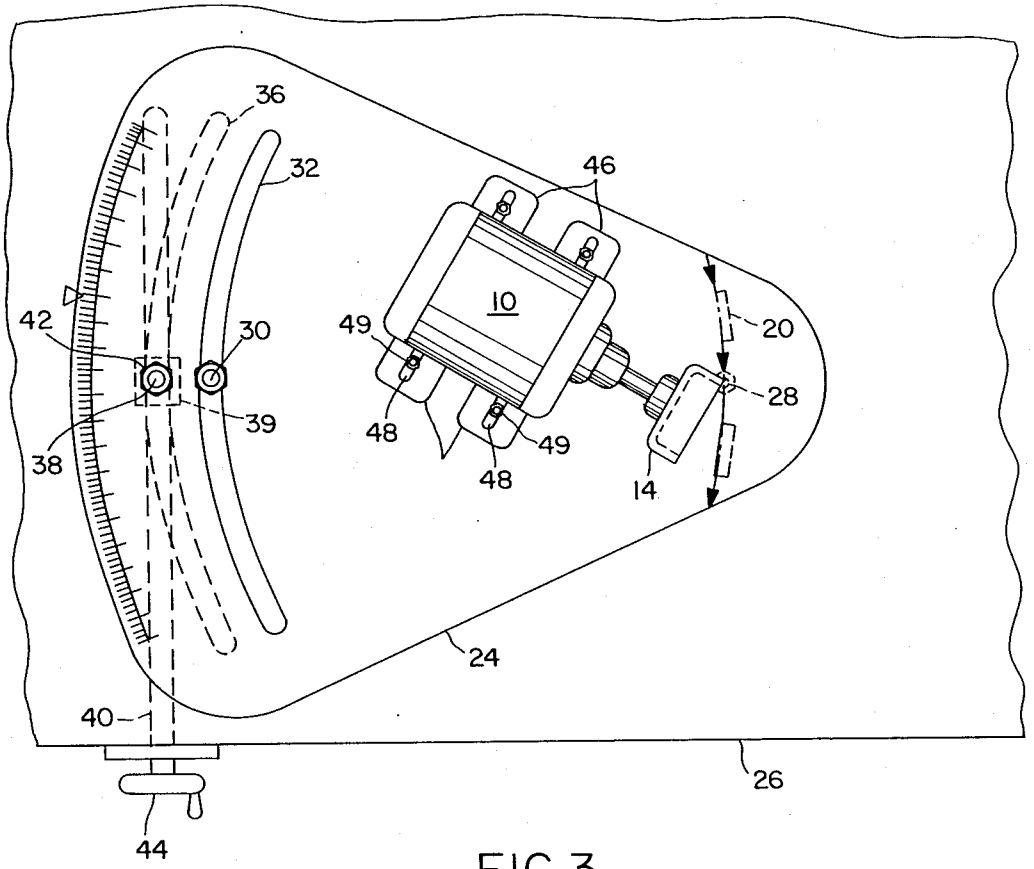
FIG. 3 shows a plan view of the motor for rotating the tool and the mounting of the motor on the base plate.

Once the final desired positions of blank 10 and tool 14 have been adjusted by adjustment of motor 10 on its mount and adjustment of blank 20 by hand wheels 90 and 82 and piston 76 as described above for purposes of generating a toric concave surface on blank 20 to satisfy a particular lens prescription, connecting member 104 is pulled out of opening 106 to disconnect radius arm 84 from fixed rack 92, and knobs 96 and 98 are turned to lock blocks 86 and 90 on radius arm 84 and rack 92. The operator then grasps the outer end of cantilever arm 52 and swings it about post 50 until blocks 58 and 60 and their connecting pin 62 cause radius arm 84 to swing about pivot pin 88 to a position (see FIG. 2) which will prepare the radius arm for return swinging movement to carry blank 20 past tool 14 and thereby generate the desired concave toric surface on blank 10 (see broken line showing positions of blank 10 in FIGS. 2 and 3). The operator grasping the far end of cantilever arm 52 then swings it back until radius arm 84 swings blank 20 past tool 14 until the desired surface has been generated on the blank.

Block 58 can be supported by means other than a swinging support arm, as long as the block is free to move horizontally in any linear or rotational direction which conforms to movement of radius arm 84. For example, block 58 may be supported on a pair of slide blocks moveable along a pair of spaced slide bars which are parallel to each other and extend horizontally at right angles to slide bar 56. However, this presents problems of locating the necessary slide bars and their supporting posts where they will not be in the way of the operator of the apparatus.

While a present preferred embodiment of the apparatus and method of operation of the invention have been described and illustrated, it will be understood that the invention is not limited thereto, but may be otherwise variously embodied and practiced within the scope of the following claims.

What is claimed is:

1. Apparatus for generating a toric surface on a lens blank comprising:

(a) a ridgid support base having a horizontally disposed upper surface, forward, rearward and side extremities, and a longitudinal axis extending between said forward and rearward extremities, (b) a motor held upon said upper surface by pivot means centered on said axis and enabling the motor to be slidably positioned along an arcuate path generally directed toward said side extremities and parallel to said upper surface, and securing means for preventing said positioning movement of the motor, said motor having an output shaft directed in general toward said rearward extremity throughout the range of said arcuate path, (c) an abrasive wheel of circular perimeter attached to said output shaft in a manner disposing said perimeter in a vertical plane angularly intersecting said axis whereby that portion of said perimeter which is most rearwardly located constitutes the cutting portion, said cutting portion being substantially centered above said pivot means, (d) a post perpendiculary emergent from said upper surface adjacent said forwad extremity, (e) a straight rigid rack member held by said post at an elevation above said wheel in parallel disposition to said upper surface and in a vertical plane which includes said axis, (f) support means positionable along said rack member and having a pivot mount, (g) a straight ridge radius arm elongated between front and rear extremities and pivotably attached to said pivot mount beneath said rack member in a manner permitting rotational movement of said radius arm in a horizontal plane above said wheel, and (h) lens blank holding means depending from said radius arm adjacent the rear extremity thereof, said holding means having a forward extremity adjustably positionable along a path that parallels said radius arm, and constructed to hold a lens blank having a forwardly disposed surface to receive a toric surface, the center axis of said lens blank substantially intersecting the rotational axis of said wheel, whereby (i) said lens blank can be swung in a curved path while contacting the cutting portion of said wheel rotating in a fixed plane, said curved path being centered upon said pivot mount, and whose radius is the distance between said pivot mount and the forward surface of the lens blank, said swinging motion of the lens blank resulting in the formation of a toric surface in its forward surface, said toric surface being concave when the center of said curved path is closer to the forward extremity of the base than the cutting portion of the wheel.

* * * * *